United States Patent [19]

Moshofsky

[11] Patent Number: 4,799,434

[45] Date of Patent: Jan. 24, 1989

[54] OUTSIDE-CORNER SHELF ASSEMBLY

[75] Inventor: Gerald S. Moshofsky, Eugene, Oreg.

[73] Assignee: Newood Products of Oregon, Inc., Eugene, Oreg.

[21] Appl. No.: 69,435

[22] Filed: Jul. 2, 1987

[51] Int. Cl.[4] ..... A47B 9/00

[52] U.S. Cl. ..... 108/108; 108/110; 108/97; 211/187; 211/205; 248/250

[58] Field of Search ..... 108/107, 108, 110, 97; 211/187, 205; 248/250; 312/281

[56] References Cited

U.S. PATENT DOCUMENTS

| | | | |
|---|---|---|---|
| 1,824,813 | 9/1931 | Friedemann | 108/108 |
| 2,401,181 | 5/1946 | Paxton et al. | 312/281 X |
| 2,480,668 | 8/1949 | Paxton et al. | 108/97 X |
| 3,259,082 | 7/1966 | Williams | 108/97 X |
| 4,203,373 | 5/1980 | Conti | 108/110 X |
| 4,262,439 | 4/1981 | Dinan et al. | 211/187 X |
| 4,706,574 | 11/1987 | Mason | 312/281 X |

*Primary Examiner*—Joseph Falk

*Attorney, Agent, or Firm*—Chernoff, Vilhauer, McClung & Stenzel

[57] ABSTRACT

A free-standing shelf assembly includes a plurality of interchangeable corner shelf members which are supported in cantilever fashion around the outside corners of the box-like support structure. The walls of the support structure include arrays of elongate, horizontally-oriented slots. Brace members inside the support structure include a plurality of pockets which correspond to the slots and are coplanar therewith. The corner shelf members each include a pair of projecting tangs which are adapted to pass through the slots in adjacent walls and are received in the pockets of the brace members to provide in-line cantilever support for the corner shelf members, including the portions which extend around the corners. An alternative embodiment without brace members employs the cooperation between a slot and a tang associated with one wall to provide cantilever support for the portion of the corner shelf associated with the adjacent wall.

12 Claims, 3 Drawing Sheets

OUTSIDE-CORNER SHELF ASSEMBLY

BACKGROUND OF THE INVENTION

This invention relates to a shelf assembly, and particularly to a shelf assembly having a shelf member which extends around the outside corner of a support structure.

Most shelves extend between two or more supporting points or are cantilevered directly out from a supporting wall. Rarely does a shelf extend around an outside corner. This is due largely to the difficulty in providing stable support for that portion of the shelf which extends around the corner. For a free-standing shelf assembly such as those used for displays in commercial or retail settings, typical shelf assemblies, having shelves which do not extend around the outside corners, waste floor space.

SUMMARY OF THE INVENTION

The present invention addresses the problems discussed above by providing a shelf assembly including a support structure having a pair of adjacent walls defining an outside corner, a corner shelf member which extends around the outside corner of the support structure and means, cooperating between the shelf member and the support structure, for supporting the shelf member around the outside corner.

In one embodiment of the invention, the adjacent walls have slots therein which are adapted to receive tangs projecting from the corner shelf. The tangs are inserted into the slots from the corner formed by the adjacent walls along an axis which bisects the angle of the corner. The portion of the corner shelf adjacent one wall is supported, in cantilever fashion, by cooperation of the tang and slot associated with the other wall.

Another embodiment employs an inner brace member, associated with a wall member, for engaging a tang of the corner shelf and cooperating with the tang to provide cantilever support for the shelf.

A further embodiment of a shelf assembly according to the present invention includes a supporting wall and a shelf member extending beyond the end of the wall, the wall having a slot and the shelf having a projecting tang extending through the slot, the shelf assembly further including a brace for engaging the tang of the shelf and for cooperating with the tang and the slot to support the shelf in cantilever fashion. The brace, shelf and slot are arranged so that a line which extends between the brace and that substantial portion of the shelf which extends beyond the supporting wall passes through the slot.

Accordingly, it is a principal objective of the present invention to provide a shelf assembly having a rigid one-piece corner shelf member which is supported around the outside corner of a support structure.

It is a further object to provide a shelf assembly including a plurality of one-piece outside corner shelf members.

It is another object to provide a freestanding shelf assembly which maximizes available shelf space including outside corners.

It is another object to provide a shelf assembly which permits rearrangement of the shelves quickly and easily without the need for tools.

It is a related object to provide a shelf assembly which provides in-line cantilever support for a substantial portion of a shelf which extends beyond the edge of a supporting wall.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 6:
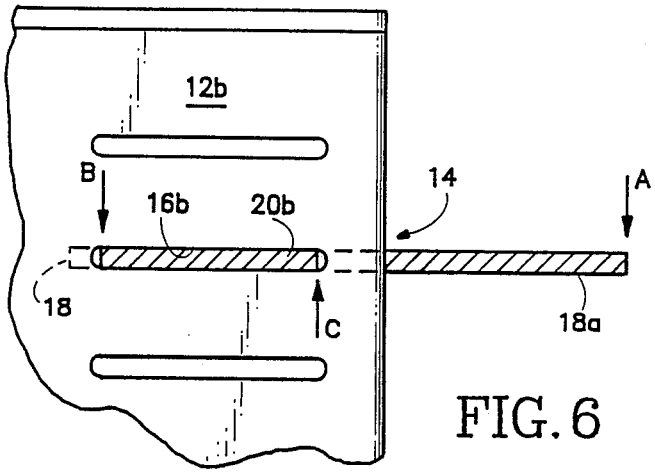
FIG. 6 is a partial sectional view of the alternative embodiment shown in FIG. 5 taken along lines 6—6.

An exemplary embodiment of the shelf assembly according to the present invention is shown in FIGS. 1–4. An alternative embodiment is shown in FIGS. 5 and 6.

Figure 1:
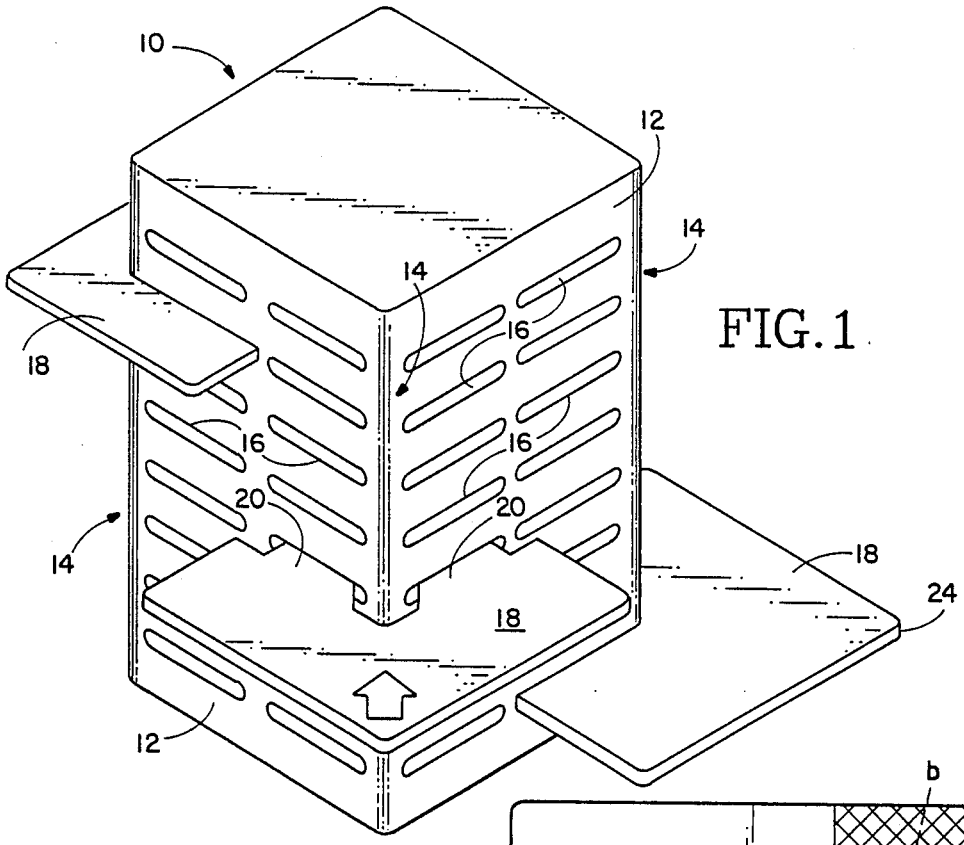
FIG. 1 is a perspective view of an exemplary embodiment of the shelf assembly of the present invention.

Starting with FIG. 1, an exemplary embodiment includes a support structure 10 including four vertical walls 12, the adjacent walls defining four outside corners 14. Each wall includes two vertical arrays of elongate, parallel, horizontally oriented slots 16, each slot being substantially coplanar with a slot around the corner on the nearest adjacent wall.

The shelf assembly also includes a rigid one-piece corner shelf member 18 which is adapted to fit around an outside corner of the support structure. The shelf member includes a pair of projecting tangs 20 which are adapted to pass through coplanar slots in adjacent walls as shown in FIG. 1. As may be seen in FIG. 2, the pair of tangs define an elongate channel 22 therebetween which is substantially coaxial with an axis which bisects the angle of the outside corner and colinear with the extreme outer corner 24 of the shelf member.

Figure 3:
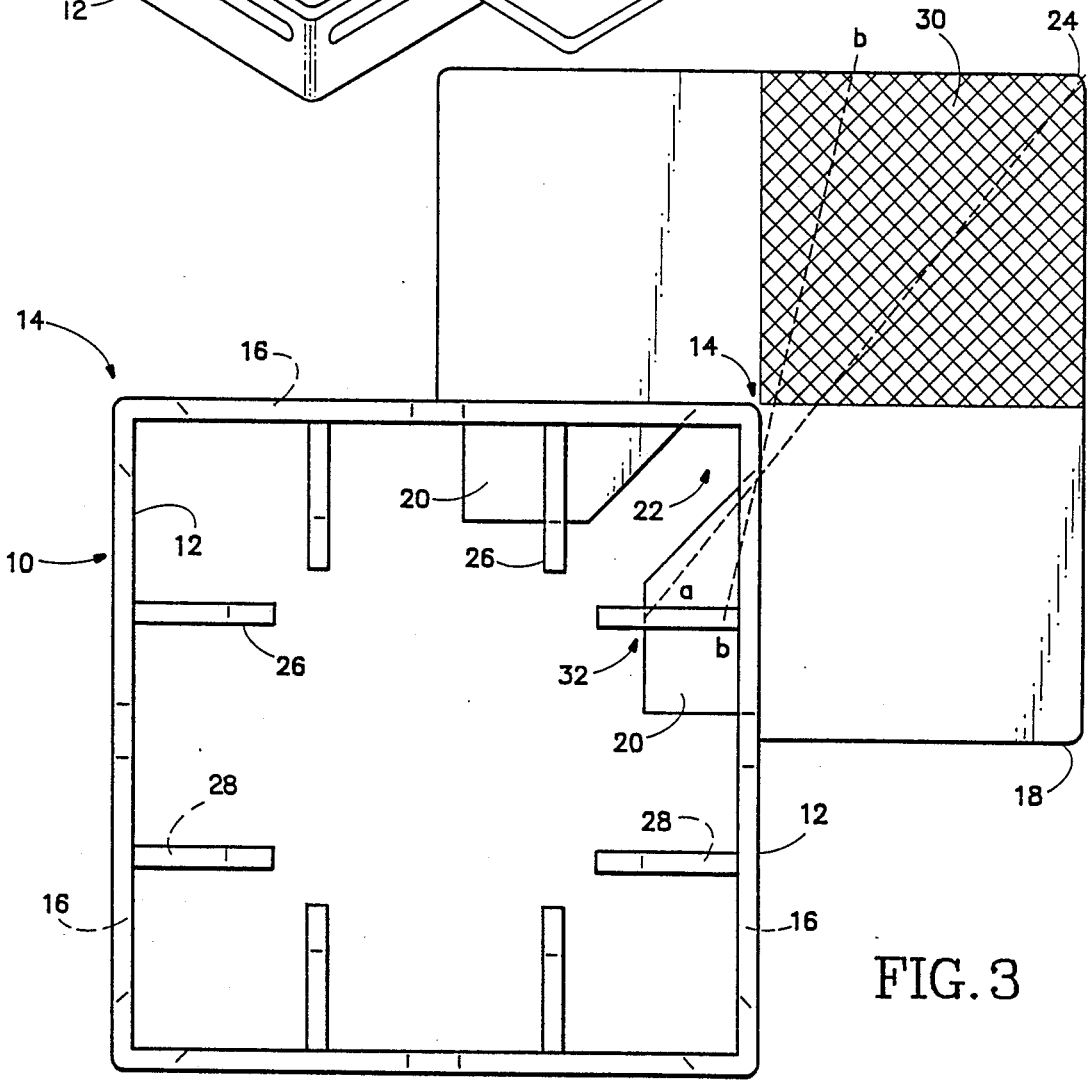
FIG. 3 is a plan view of the embodiment of FIG. 1 with the top of the supporting structure removed to reveal the inner details of the assembly.
Figure 2:
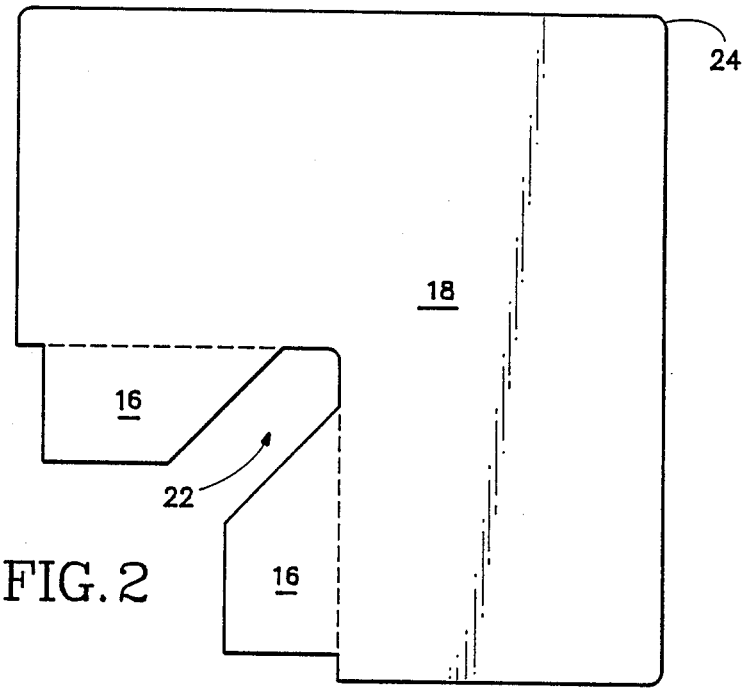
FIG. 2 is a plan view of a corner shelf member as shown in FIG. 1.
Figure 4:
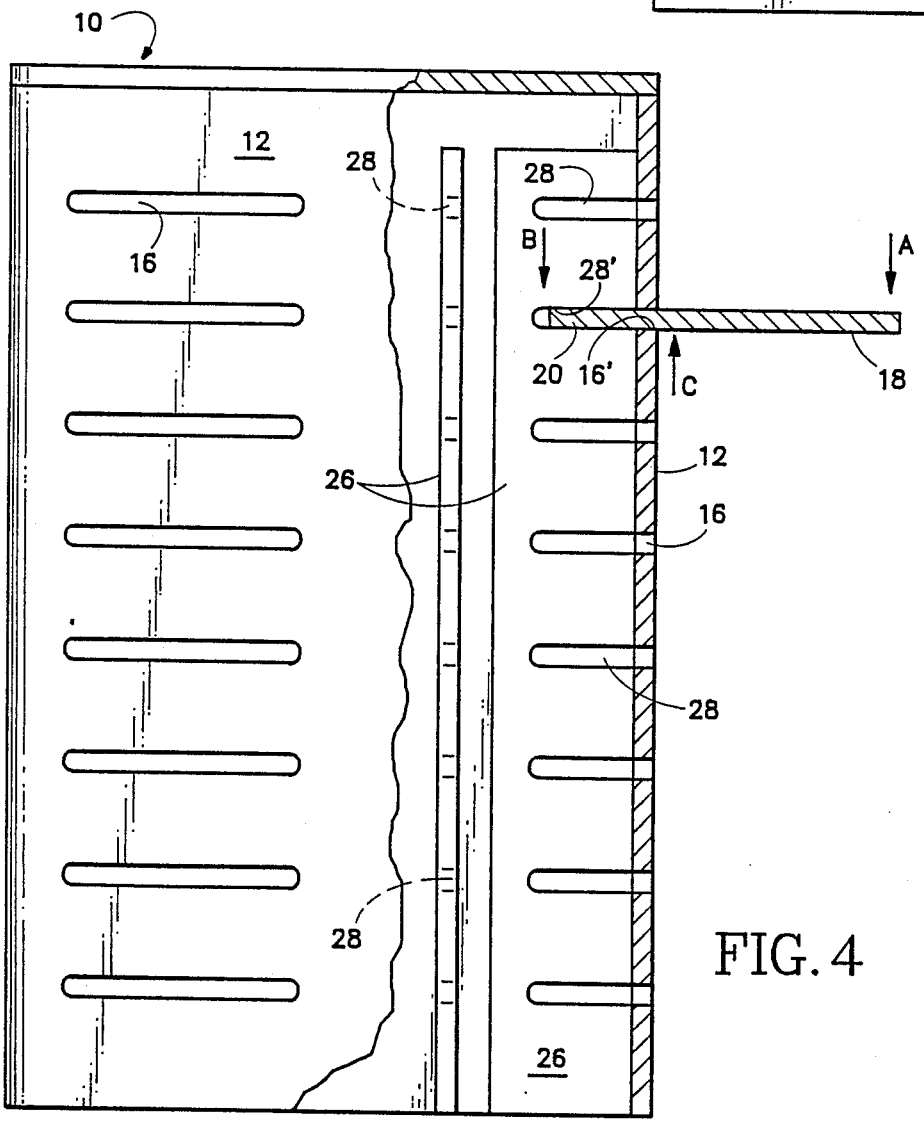
FIG. 4 is an elevational view of the embodiment of FIG. 3 which is partially broken away to show the inner details of the assembly.
Figure 5:
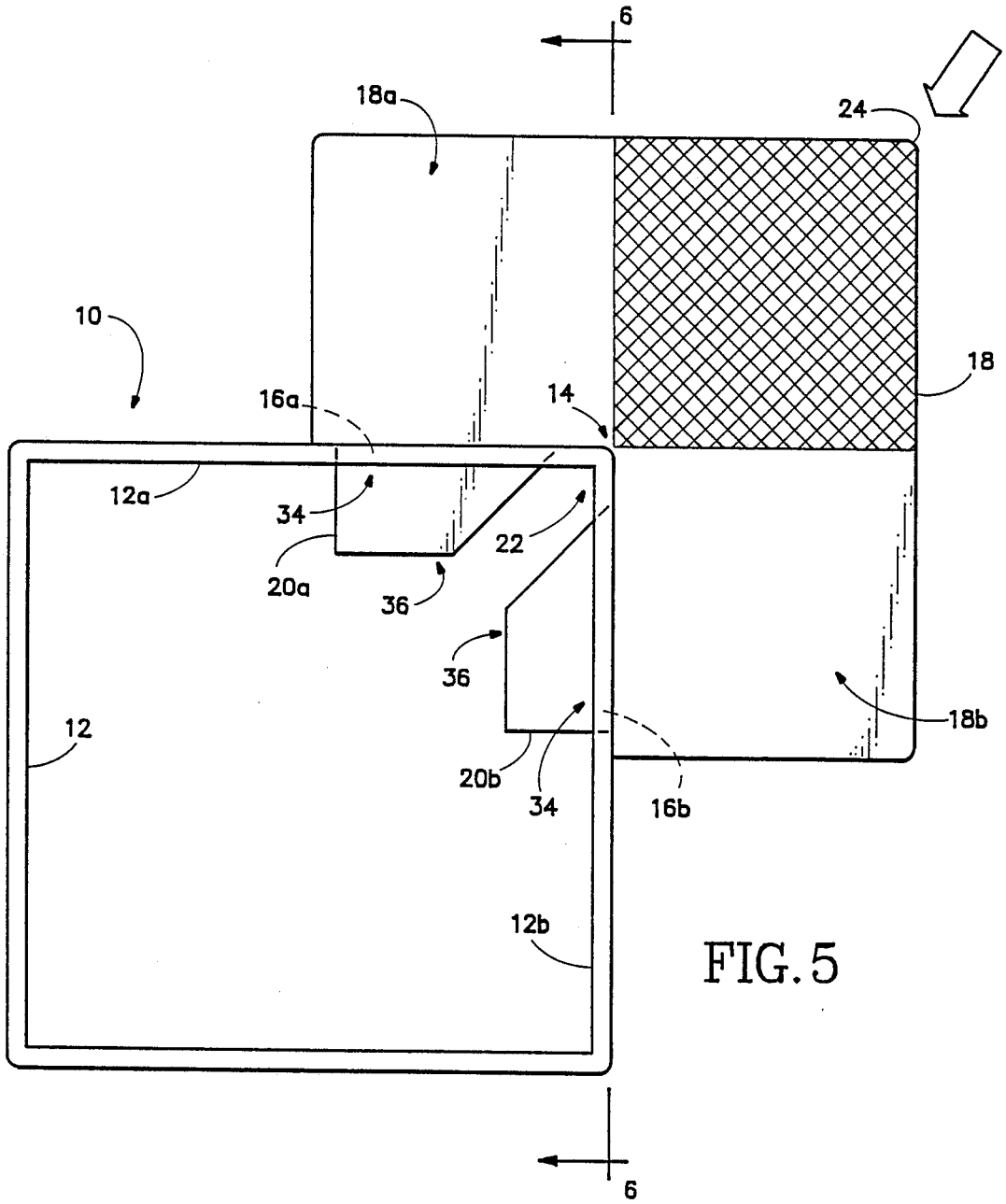
FIG. 5 is a plan view of an alternative embodiment of the shelf assembly of FIG. 1 with the top of the supporting structure removed to reveal the inner details of the assembly.

Turning to FIGS. 3 and 4, vertical brace members 26, associated with each vertical array of slots, are fixed to the interior walls of the support structure. The brace members are oriented substantially perpendicular to their respective walls and include a plurality of pockets 28 formed therein, the pockets corresponding to, and substantially coplanar with, the slots in the wall.

The shelf assembly is assembled by inserting the tangs of a shelf member through coplanar slots in adjacent walls until the tangs are seated in the pockets of the brace members. In this fashion the shelf member is supported around the outside corner of the support structure in cantilever fashion, the tang of the shelf member cooperating with the lower edge 16' of the slot and the upper edge 28' of the pocket to provide cantilevered support for the shelf. Referring specifically to FIG. 4, it will be understood that a weight represented by downward arrow A on the shelf is supported by forces B and C acting on the tang of the shelf.

Turning now to FIG. 3, it will be appreciated that shelves do not typically extend around an outside corner in the cross hatched area 30 because it is difficult to provide adequate support for objects resting in the cross hatched area beyond the edges of the supporting walls. The present invention provides a shelf assembly which supplies in-line cantilever support for the shaded area. The dashed line a—a in FIG. 2 drawn between the outer corner 24 of the shelf and the brace point 32, where the tang of the shelf presses up against the pocket in the brace member, passes through the slot in the wall, the lower edge of the slot providing the upward force component of the cantilever support.

Referring still to FIG. 3, it may be seen that the slot and brace acting upon the tang of the shelf would provide in-line cantilever support for a shelf which extends beyond the supporting wall, but does not extend around the corner, since line b—b also passes through the slot in the supporting wall. However, it should be noted that the corner shelf arrangement disclosed in FIGS. 1–4 is particularly strong and stable since most portions of the cross-hatched area have in-line cantilever support from both supporting walls.

In addition to the in-line cantilever support provided by cooperation of the tangs and braces, the tangs also cooperate with the slots to provide cantilever support for that portion of the corner shelf which is around the corner from a tang-and-slot combination. While this principle will be discussed with respect to the alternative embodiment described below, cooperation of the tangs and slots in the embodiment shown in FIGS. 3 and 4 contribute to the overall strength and stability of the corner shelf assembly.

Turning to FIGS. 5 and 6, an alternative embodiment is shown which does not include the brace members 26 shown in FIGS. 3 and 4. In the alternative embodiment, like the previous embodiment, the tangs 20 of the corner shelf 18 are inserted into the slots 16 by moving the corner shelf toward the support structure 10 along an axis which bisects the outside corner 14 of the support structure. This "corner insertion" concept is shown by the broad arrows in FIGS. 1 and 5.

When the tangs are fully inserted into the slots, the rigid corner shelf is supported in cantilever fashion without brace members by cooperation between the tangs and the slots. Referring to FIG. 5, a first wall member 12*a* has a first slot 16*a* having a first tang 20*a* extending therethrough. Similarly, a second wall member 12*b* has a second slot 16*b* with a second tang 20*b* extending therethrough. The corner shelf has a first portion 18*a* proximate said first wall member and a second portion 18*b* proximate said second wall member. Cooperation of the second tang 20*b* and the second slot 16*b* provide cantilever support for the first portion of the corner shelf, while cooperation of the first tang 20*a* with the first slot 16*a* provides cantilever support for the second portion 18*b* of the corner shelf.

Referring to FIG. 6, a weight represented by downward arrow A on the first portion 18*a* of the corner shelf is supported by forces B and C acting upon the second tang 20*b* of the shelf. As may be seen in FIG. 5, the base 34 of the respective tangs is wider than the tips 36. The broad base of the tang increases the load bearing capability of the shelf.

Referring to FIG. 1, it may be seen that the shelf assembly of the present invention can accommodate a variety of shelf arrangements. The array of slots 16 permit the entire support structure 10 to be ringed with multiple rows of shelves 18, each ring of shelves extending continuously around the support structure. Alternatively, the shelves could be arranged as shown in FIG. 1 for aesthetic reasons, or to accommodate tall objects placed upon the shelves. As also shown in FIG. 1, the shelves may be of various sizes, yet be operatively supported by the support structure in identical fashion.

Finally, the shelf assembly of the present invention may be assembled, dismantled, or rearranged quickly and easily without the need for tools by merely removing the tangs of the shelf member from one pair of slots and inserting them into another.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A shelf assembly comprising:

(a) a support structure having adjacent first and second substantially vertical wall members defining a substantially vertical outside corner;

(b) a substantially planar shelf member adapted to fit horizontally around said outside corner of said support structure;

(c) said first and second wall members respectively including first and second horizontal slots coplanar with each other; and (d) said shelf member including first and second horizontally projecting tangs, coplanar with said shelf member, said tangs adapted to be substantially simultaneously inserted into said first and second slots, respectively, by movement of said shelf member along a horizontal axis bisecting said outside corner.

2. The shelf assembly of claim 1 wherein said first and second wall members define an inside corner, said inside corner including first and second brace means for respectively engaging said first and second tangs extending respectively through said first and second wall members and supporting said shelf member around said outside corner.

3. The shelf assembly of claim 1 wherein said first and second tangs define an elongate channel therebetween.

4. The shelf assembly of claim 3 wherein said shelf member includes an outer corner remote from said first and second wall members, said outer corner being substantially colinear with said elongate, channel.

5. The shelf assembly of claim 1, including four upright wall members defining a rectangular solid.

6. The shelf assembly of claim 2 wherein said first and second brace means respectively include first and second pocket means for respectively receiving said first and second tangs.

7. The shelf assembly of claim 6 wherein said first and second slot means and said first and second pocket means are substantially coplanar.

8. The shelf assembly of claim 1 wherein said shelf member includes a portion which extends beyond the edges of said first and second wall members, said attachment means including means for providing in-line cantilever support for said portion.

9. The shelf assembly of claim 8 wherein said first and second wall members provide support for said shelf member, said attachment means including means for providing in-line cantilever support for said portion from both of said first and second wall members.

10. The shelf assembly of claim 1 wherein said tangs respectively include a tip portion remote from said shelf member and a base portion proximate said shelf member, said base portion being larger than said tip portion.

11. The shelf assembly of claim 10 wherein said respective base portions of said tangs cooperate with said respective slots to support those respective portions of said shelf member which are around said outside corner of said support structure.

12. The shelf assembly of claim 1 wherein said shelf member includes a first portion proximate said first wall member, said second tang cooperating with said second wall member to provide cantilever support to said first portion of said shelf member.

* * * * *